United States Patent [19]

Kimpel

[11] 4,325,043

[45] Apr. 13, 1982

[54] POLARIZED MAGNET SYSTEM

[75] Inventor: Rolf-Dieter Kimpel, Unterschweinbach, Fed. Rep. of Germany

[73] Assignee: Siemens Aktiengesellschaft, Berlin & Munich, Fed. Rep. of Germany

[21] Appl. No.: 227,961

[22] Filed: Jan. 23, 1981

[30] Foreign Application Priority Data

Feb. 25, 1980 [DE] Fed. Rep. of Germany ..... 3006948

[51] Int. Cl.[3] ..... H01F 7/08

[52] U.S. Cl. ..... 335/229; 335/80; 335/234

[58] Field of Search ..... 335/79, 80, 81, 229, 335/230, 234

[56] References Cited

U.S. PATENT DOCUMENTS 2,866,927 12/1958 Berg et al. ..... 317/171
3,017,474 1/1962 Huetten ..... 335/229 X
3,993,971 11/1976 Ono et al. ..... 335/202
4,191,937 3/1980 Koehler et al. ..... 335/230
4,237,439 12/1980 Nemoto ..... 335/79

FOREIGN PATENT DOCUMENTS 2407184 8/1975 Fed. Rep. of Germany ..... 335/229

*Primary Examiner*—George Harris
*Attorney, Agent, or Firm*—Hill, Van Santen, Steadman, Chiara & Simpson

[57] ABSTRACT

A polarized magnet system for a relay has a rotary armature having a pair of opposed parallel pole-piece plates which enclose permanent magnets and which terminate in spaced pole-plate piece ends which surround the pole-pieces of a coil core in clamp-like fashion and form working air gaps with the core. The ends of the ferromagnetic pole-piece plates are angled to form a tab in the direction of the coil core so that the working air gaps are shifted in the direction of the coil permitting the permanent magnets to occupy the entire distance between the pole pieces commensurate with the overall armature length.

8 Claims, 9 Drawing Figures

FIG 1
(PRIOR ART)
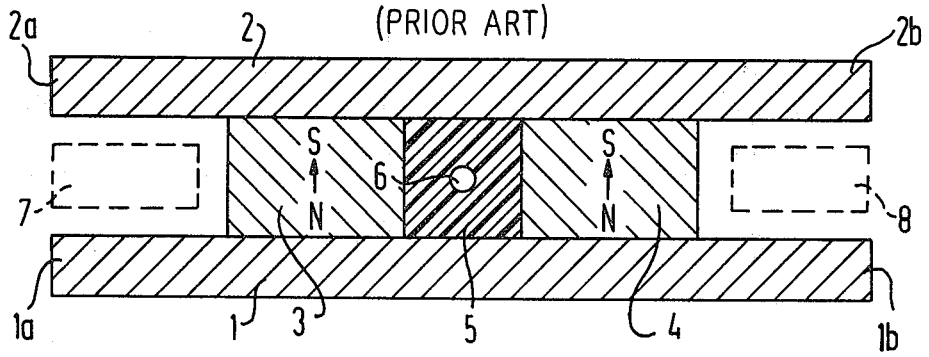
FIG 2
FIG 4
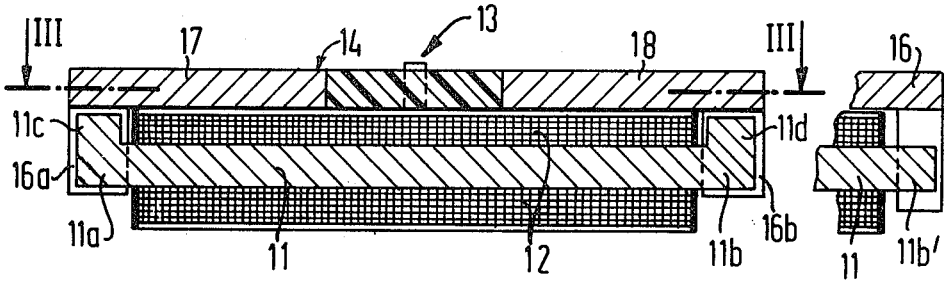
FIG 3
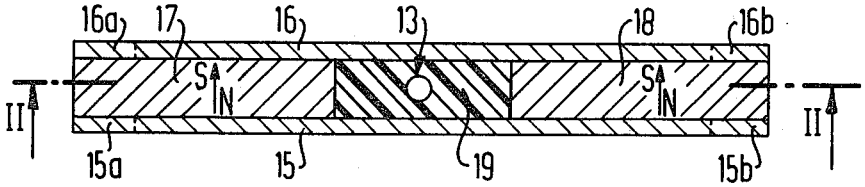

POLARIZED MAGNET SYSTEM

BACKGROUND OF THE INVENTION

1. Field of the Invention

The present invention relates to a polarized magnet system and in particular to such a system for use in a relay.

2. Description of the Prior Art

Polarized magnet systems having a coil with an iron core and an elongated or longitudinally extended rotary armature which bears a permanent magnet arrangement wherein the rotary armature is disposed essentially parallel to the coil axis and is mounted approximately above the coil center and wherein the armature has parallel pole-piece legs with leg ends terminating in spaced relation to surround the ends of the coil core in a tong or clamp-like fashion to form the working air gaps are known in the art. Such conventional magnet systems generally employ a so-called H- or TT armature, examples of which are disclosed and claimed in U.S. Pat. No. 2,866,927 and U.S. Pat. No. 3,993,971. Such conventional armature structures are generally comprised of two elongated iron legs which are disposed parallel and which enclose either in the bearing region or on both sides of the bearing region one or more permanent magnets such that the respective leg ends remain free in spaced relation. Angled yoke legs extend between the spaced leg ends.

H-armatures of this type, with a given overall length of the coil and armature, can contain only relatively short permanent magnets, because the major portion of the volume between the armature legs must remain free for the formation of the working air gaps. Because of this limited volume available for the permanent magnet, high-grade and expensive magnetic materials must be employed in order to achieve the necessary amount of magnetic flux for efficient operation of the magnet system.

SUMMARY OF THE INVENTION

It is an object of the present invention to provide a polarized magnet system which may be used in a relay which permits the entire volume between the pole-piece legs to be utilized to contain permanent magnets so that the size of the magnets employed is limited only by the size of the armature itself.

The above object is inventively achieved in a polarized magnet system in which the armature pole-piece plates or legs are angled or bent at their respective ends perpendicularly to the coil axis in the direction of the coil core so that the spaced angled leg ends form tabs, between which is the working air gap at each end. The permanent magnets can thus extend completely to the end of the pole-piece plates so as to be as long as the armature itself. With this enlarged permanent magnet volume, the permanent magnetic flux is correspondingly enlarged. This feature is of particular importance in miniaturized magnet systems employed, for example, in relays wherein the size of the miniature magnet system has previously been an impediment to optimum operation thereof for the reason that the amount of magnetic flux was insufficient. A further advantage of the angled armature pole-piece ends is that the working air gap is displaced in the direction of the coil so that the control flux can be better utilized because leakage or stray fluxes are reduced.

Because of the angling of the armature pole-piece ends, the core need no longer be provided with long yoke legs, as in the case of conventional systems employing an H-armature. The coil core may be designed simply as a straight piece and may possess at the two ends thereof axially protruding pole ends. In order to enlarge the pole surfaces, however, short angle pieces may be formed or molded onto the coil core in the direction of the armature. In one embodiment of the present invention, the armature consists of two parallel U-shaped metal plates between which the permanent magnets are arranged on both sides of the bearing with unidirectional polarization. In another embodiment of the invention, the armature has two metal plates disposed in a plane parallel to the coil axis, each plate having an end having a tab depending therefrom in a direction parallel to the pole faces of the core, and a flat permanent magnet arrangement covers both plates. This flat permanent magnet arrangement may, for example, be polarized parallel to the plane of the plate, in which case the permanet magnet circuit is closed directly above the two plates. The permanent magnet arrangement may, however, be polarized in opposite directions perpendicular to the plane of the plate, in which case it is preferable to affix an additional flux guide plate above the permanent magnet arrangement.

For a monostable magnet system, the armature may consist of two armature pole-piece plates disposed in a Z-formation with a ferromagnetic center piece, and two pole pieces coupled with the pole-piece plates via one permanent magnet for each.

DESCRIPTION OF THE DRAWINGS

FIG. 1 is a sectional view of a conventional H-armature taken transversely to the axis of rotation.

FIG. 2 is a sectional view of a magnet system constructed in accordance with the principles of the present invention taken along line II—II of FIG. 3.

FIG. 3 is a sectional view taken transversely to the axis of rotation of the system shown in FIG. 2 along line III—III.

FIG. 4 is a side view of a portion of the magnet system shown in FIG. 2 showing a modified embodiment thereof.

DESCRIPTION OF THE PREFERRED EMBODIMENT

Figure 5:
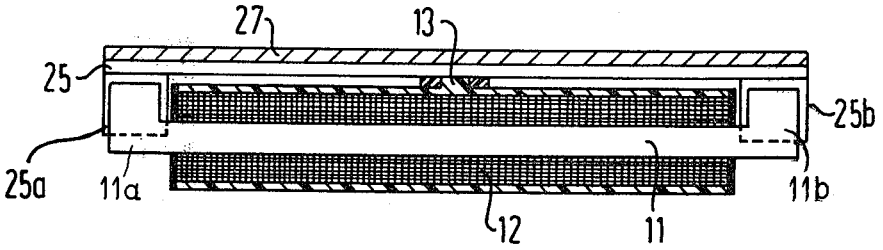
FIG. 5 is a side view, partly in section, of a further embodiment of the magnet system shown in FIG. 2.

A conventional H-armature is shown in section in FIG. 1 of the type employed in known magnet systems. The armature essentially consists of two ferromagnetic bars or plates 1 and 2 which are disposed parallel to one another and which enclose two permanent magnets 3 and 4. A center section 5 consisting of non-ferromagnetic material such as, for example, plastic, contains a bearing bushing 6. The armature is mounted with the bearing bushing 6 on a coil (not shown) such that the respective ends 1*a* and 2*a* of the bars 1 and 2 form a working air gap with a yoke leg 7, as do the ends 1*b* and 2*b* with a yoke leg 8. In such conventional H-armature construction, the space for the yoke legs 7 and 8 must be left vacant in the armature so that only relatively little volume is available for the permanent magnets 3 and 4.

In contrast to the conventional armature structure shown in FIG. 1, a magnet system constructed in accordance with the principles of the present invention is shown in FIGS. 2 and 3. As shown in those FIGS., a coil core 11 supports a winding 12. A portion of a bearing journal is shown in FIG. 2 on which the armature 14 is mounted. The armature 14 consists of two armature legs comprised of two ferromagnetic pole-piece plates 15 and 16 having respective opposite ends 15*a* and 15*b*, and 16*a* and 16*b* which form angled or bent tabs depending from the pole-piece plates 15 and 16 in the direction of the coil. The coil core 11 has opposite ends 11*a* and 11*b* which form poles face which are similar made as large as possible by tabs 11*c* and 11*d* formed thereon. The tabs 15*a* and 16*a* surround the pole face tab 11*c*, while the tabs 15*b* and 16*b* surround the pole face tab 11*d*. Each pair of pole-piece ends forms a working air gap with the respective ends of the coil core 11.

A portion of the magnet system shown in FIG. 2 is illustrated in modified form in FIG. 4 wherein the pole face or end 11*b*′ is simply a straight extension of the core and does not exhibit any angled or bent tab. This embodiment is particularly simple to manufacture.

As shown in FIG. 3, between the two pole-piece plates 15 and 16 are disposed two permanent magnets 17 and 18 and a center piece 19 comprised of non-ferromagnetic material. The magnets 17 and 18 occupy the entire length of the armature 14 with the exception of the center piece 19. The armature no longer has the conventional H-shape, but rather displays a sandwich-like construction. The ends 15*a*, 15*b*, 16*a* and 16*b* of the pole-piece plates 15 and 16 are designed so as to be disposed adjacent to the ends of the core 11 by the shortest path possible from the plates 15 and 16 and further enclose or surround the ends of the core 11 in a tong or clamp like fashion.

Figure 6:
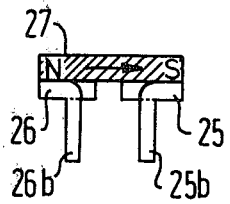
FIG. 6 is an end view of the magnet system of FIG. 5 seen from the right end.

A further embodiment of the magnet system shown in FIG. 2 is illustrated in FIGS. 5 and 6. In this embodiment, the armature consists of two flat metal plates 25 and 26 which are disposed parallel to one another in a single plane. Each plate exhibits at opposite ends thereof lateral tabs such as tabs 25*a* and 25*b* which can be seen in FIG. 5 and tab 26*b* which can be seen in FIG. 6. The plate 26 also possesses a similar tab at the end thereof opposite to the tab 26*b* which cannot be seen in FIG. 6. The tabs are bent downwardly in the direction of the coil core. A flat permanent magnet 27 is disposed on top of, instead of between, the plates 25 and 26 and covers the entire surface of the two plates 25 and 26. In the embodiment shown in FIGS. 5 and 6, the permanent magnet 27 is polarized in a transverse direction, that is, parallel to the plane of the armature, so that one pole of the magnet 27 is connected to a respective one of the plates 25 and 26.

Figure 7:
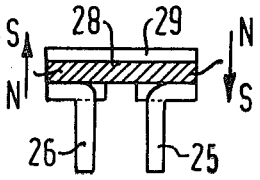
FIG. 7 is an end view of a further embodiment of the magnet system shown in FIGS. 5 and 6.

In a further modification of the embodiment shown in FIG. 5, which is illustrated in FIG. 7, a permanent magnet 28 which also is disposed flat on the plates 25 and 26, has directions of magnetization which are perpendicular to the plane of the armature. In this embodiment, a flux plate 29 is additionally disposed above the permanent magnet 28 in order to close the permanent circuit and to reduce leakage or stray flux.

Figure 8:
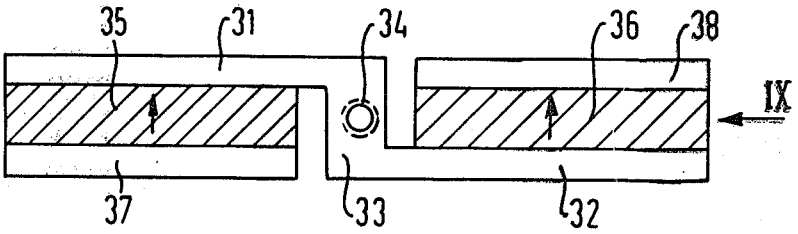
FIG. 8 is another embodiment of the magnet system shown in FIG. 2 constructed in accordance with the principles of the present invention.
Figure 9:
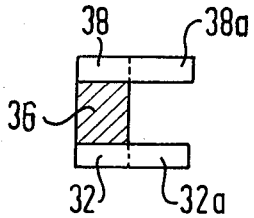
FIG. 9 is an end view of the magnet system shown in FIG. 8 as seen from the right end.

One further embodiment is shown in FIG. 8 for a monostable magnetic system. In this embodiment, two armature legs 31 and 32 are connected via a ferromagnetic center section 33 forming a Z-shaped configuration which is mounted at the center section 31 on a journal or pin 34. The armature leg 31 is connected to a pole-piece 37 via a permanent magnet 35, and the armature leg 32 is connected to a pole-piece 38 via a permanent magnet 36. As can best be seen in FIG. 9, each of the legs 31 and 32 and the pole-pieces 37 and 38 have tabs which depend therefrom in the direction of the core (not shown). One tab 38*a* for the pole-piece 38 can be seen in FIG. 9, as well as one tab 32*a* for the corresponding armature leg 32. It will be understood that the armature leg 31 and the pole-piece 37 possess similar tabs which cannot be seen in FIG. 9.

The permanent magnets 35 and 36 are in this embodiment polarized in series so that in a rest state the pole-pieces 37 and 38 are attracted to the core. It is only in this state that the permanent magnet circuits are closed. Upon excitation of the magnetic system, the armature legs 31 and 32 are attracted to the respective core ends (not shown) and in this manner monostable switching is obtained.

Although modifications and changes may be suggested by those skilled in the art it is the intention of the inventor to embody within the patent warranted hereon all changes and modifications as reasonably and properly come within the scope of his contribution to the art.

I claim as my invention:

1. A polarized magnet system comprising:

a coil having a ferromagnetic core having a longitudinal axis;

an elongated rotary armature having a permanent magnet means thereon, said rotary armature being disposed substantially parallel to said coil axis and approximately above a center of said coil, said armature having opposite ends each terminating in a pair of spaced tabs depending substantially perpendicular to said coil axis in the direction of said coil core;

said coil having opposite ends respectively extending between and surrounded on opposite sides by respective pairs of said tabs to form a working air gap; and said permanent magnet means extending to said ends of said armature legs and terminating therewith.

2. The magnet system of claim 1 wherein each of said armature legs consists of a pair of spaced parallel U-shaped metal plates disposed on opposite sides of a centrally disposed bushing, and wherein said permanent magnet means consists of two permanent magnets disposed between said metal plates on opposite sides of said bearing, each said permanent magnet extending to the end of a respective armature leg.

3. The magnet system of claim 1 wherein said coil core is a straight rod.

4. The magnet system of claim 1 wherein said coil core has a pair of core tabs at each end thereof extending substantially perpendicularly to said core axis in the direction of said rotary armature.

5. The magnet system of claim 1 wherein each of said armature legs is comprised of a pair of spaced metal plates disposed in a plane parallel to said coil axis, each of said metal plates having at respective opposite ends thereof a tab depending toward said coil core substantially perpendicular to said core axis, and wherein said permanent magnet means is a flat permanent magnet extending along the entire length of said metal plates.

6. The magnet system of claim 5 wherein said permanent magnet is magnetized parallel to a plane containing said metal plates.

7. The magnet system of claim 5 wherein said permanent magnet is magnetized in a direction perpendicular to a plane containing said metal plates and further comprising a flux plate covering said permanent magnet for closing the magnetic path formed thereby.

8. The magnet system of claim 1 wherein each of said armature legs consists of first pole-pieces which are joined to a center section in a Z-shaped member and second pole-pieces spaced from said first pole-pieces and wherein said permanent magnet means is a pair of permanent magnets respectively disposed between the first and second pole-pieces in each armature leg for coupling said pole-pieces, and wherein said center section is comprised of ferro-magnetic material for connecting said permanent magnets in series.

* * * * *